US012025364B2

(12) United States Patent
Fagundes et al.

(10) Patent No.: US 12,025,364 B2
(45) Date of Patent: Jul. 2, 2024

(54) REFRIGERATOR COOLING SYSTEM

(71) Applicant: WHIRLPOOL CORPORATION, Benton Harbor, MI (US)

(72) Inventors: Tiago Deived Fagundes, Joinville (BR); Paulo César Rosales Palomino, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 313 days.

(21) Appl. No.: 17/667,930

(22) Filed: Feb. 9, 2022

(65) Prior Publication Data

US 2023/0251012 A1 Aug. 10, 2023

(51) Int. Cl.
*F25D 17/06* (2006.01)
*F25D 11/02* (2006.01)

(52) U.S. Cl.
CPC ..... *F25D 17/065* (2013.01); *F25D 11/02* (2013.01); *F25D 2317/0671* (2013.01)

(58) Field of Classification Search
CPC ..... F25D 17/065; F25D 11/02; F25D 2317/0671; F25D 17/045
See application file for complete search history.

(56) References Cited

U.S. PATENT DOCUMENTS 8,806,885 B2 * 8/2014 Bae ..... F25D 17/065 62/407
2021/0262718 A1 8/2021 Burlingham et al.

FOREIGN PATENT DOCUMENTS

KR 20120091556 A 8/2012
WO 2021042188 A1 3/2021

* cited by examiner

*Primary Examiner* — Ana M Vazquez
(74) *Attorney, Agent, or Firm* — Brooks Kushman P.C.

(57) ABSTRACT

A cooling system including an air distribution plenum, a heat exchanger, a first fan, a second fan, an air damper, and a first air duct. The air distribution plenum is provided with a first side and a second side and defines first aperture and a second aperture. The first side forms a number of passages fluidly connected to a first compartment and a second compartment. The first fan is coupled to the air distribution plenum and configured to direct air from the heat exchanger through the first aperture to the number of passages. The second fan is coupled to the air distribution plenum and configured to direct air from the heat one or more of the number of compartments. The air damper is configured to selectively block the air from at least one of the first fan and the second fan.

19 Claims, 6 Drawing Sheets

REFRIGERATOR COOLING SYSTEM

TECHNICAL FIELD

The present disclosure relates to an appliance such as a refrigerator.

BACKGROUND

Refrigerators generally may include a fan assembly that controls or regulates the amount of cooled air provided to one or more compartments of the refrigerator. The fan assembly may be disposed in a cold air passage to maintain a desired temperature of each compartment. The fan assembly may include a frame provided with one or more openings or air passages that may route cooled air to the compartments and a damper that may be rotated by a motor to selectively open or close the air passages.

SUMMARY

According to one embodiment, a cooling system for use in a refrigerator, is provided. The refrigerator may include a number of compartments and the cooling system may be provided with a heat exchanger mounting assembly, a heat exchanger, a first fan, a second fan, an air damper, and a first air duct. The heat exchanger mounting assembly may include an air distribution plenum provided with a first side and a second side. The air distribution plenum may define a first aperture and a second aperture. One or more of the apertures may extend from the first side to the second side and the first side may form a number of passages that may be fluidly connected to a first compartment and a second compartment of the number of compartments. The heat exchanger may be disposed on the heat exchanger mounting assembly. The first fan may be coupled to the heat exchanger mounting assembly and may be configured to direct air from the heat exchanger through the first aperture to a first passage and a second passage each of the number of passages. The second fan may be coupled to the heat exchanger mounting assembly and configured to direct air from the heat exchanger through the second aperture to a third compartment of the number of compartments. The air damper may be fixed to the heat exchanger assembly and configured to selectively block the air from at least one of the first fan and the second fan. The air duct may include a first end and a second end, the first end covering portions of the first compartment and the second end disposed adjacent to the heat exchanger.

According to another embodiment, a refrigerator is provided. The refrigerator may include a cabinet, a mounting member, an evaporator, a first fan, a second fan, and first and second air ducts. The cabinet may form a number of refrigerated compartments and may be provided with an inner liner and an outer wrapper. The inner liner and the outer wrapper may collectively form a machine compartment. The mounting member may be disposed in the machine compartment and may include a first side and a second side, the first side may form a number of passages that may be fluidly connected to a first refrigerated compartment of the number of compartments and a second refrigerated compartment of the number of compartments. The evaporator may be disposed on the second side of the mounting member and the first fan may be fixed to the mounting member and configured to direct cooled air from the evaporator to at least one of the first refrigerated compartment and the second refrigerated compartment. The second fan may be fixed to the mounting member and may be configured to direct cooled air from the evaporator to at least one of the second refrigerated compartment or a third refrigerated compartment of the number of refrigerated compartments. The first air duct may be configured to route air between the first refrigerated compartment and the machine compartment, and the first air duct may be disposed on a first side of the first fan the second fan is disposed on a second side of the first fan and the second fan may be disposed on a second side of the first fan. The second air duct may be configured to route air between the second refrigerated compartment and the machine compartment. The first fan and the second fan may each be disposed between the first and second air ducts.

According to yet another embodiment, a refrigerator is provided. The refrigerator may include a cabinet, a mounting member, an evaporator, a first fan, a second fan, and a damper. The cabinet may include an inner liner and an outer wrapper. The inner liner may form a refrigerator compartment, an ice maker compartment, and a freezer compartment, and the inner liner and the outer wrapper may collectively form a machine compartment. The mounting member may be disposed in the machine compartment. The mounting member may include a first side and a second side that may each extend in a vertical direction between a top surface and a bottom surface that may each extend in a horizontal direction between a first lateral surface and a second lateral surface. The first side may form a number of passages that may be fluidly connected to the freezer compartment and the top surface may define a first aperture that may be fluidly connected to the refrigerator compartment. The heat exchanger may be disposed on the second side of the mounting member. The first fan may be disposed in a second aperture between the first side and the second side of the mounting member. The first fan may be configured to direct cooled air from the second side of the mounting member through the first and second aperture to the refrigerator compartment and the freezer compartment, respectively. The second fan may be configured to direct cooled air from the heat exchanger to the ice maker compartment. The damper may be disposed on the top surface of the mounting member and may be configured to block cooled air form at least one of the first fan and the second fan. The first and second fans may be disposed between the heat exchanger and the top surface of the air distribution plenum.

DETAILED DESCRIPTION

Figure 1:
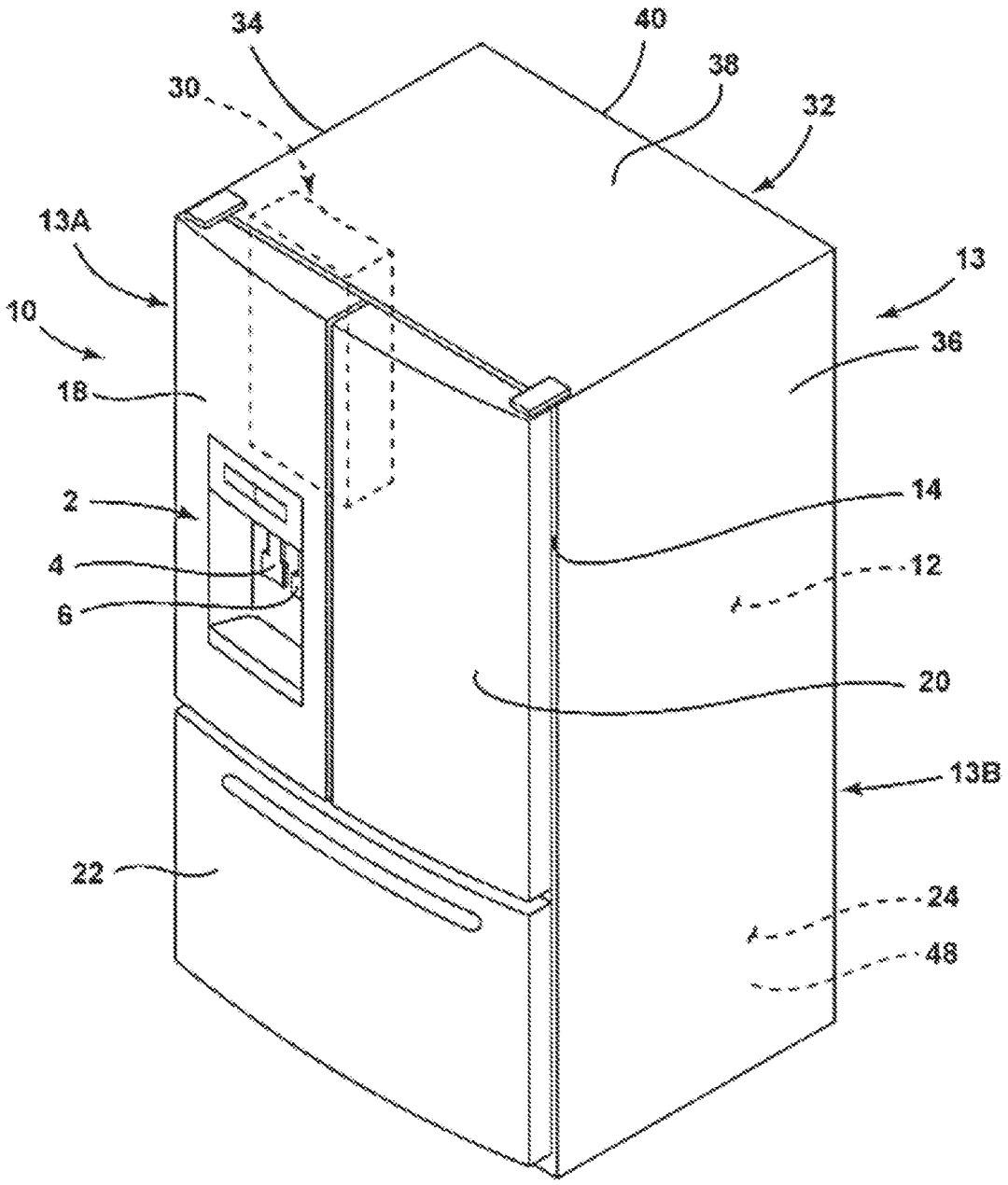
FIG. 1 illustrates a top-perspective view of an exemplary refrigerator.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Refrigerators must maintain a low temperature to prevent food and beverages from spoiling while being stored within one or more food storage spaces. Each of the food storage spaces may be insulated to block or mitigate heat from outside air from penetrating the food storage space. The food storage space may be formed of an insulative structure and a number of heat exchangers (e.g., evaporators, condensers, compressors) may be disposed within one or more compartments (e.g., machine compartment). The heat exchangers may be configured to absorb heat inside the food storage space or dissipate heat to an area external to the food storage area. One of the challenges with known refrigerators is the ability to provide sufficient cooling to each of the food storage spaces such as a refrigerator compartment, ice maker compartment, freezer compartment, and conversion compartment while providing sufficient storage space within these compartments and minimizing the overall size of the refrigerator. Known refrigerators generally include two or more heat exchangers one or more of which may be dedicated to cool one of the refrigerated compartments.

The present disclosure attempts to resolve one or more of the above-mentioned problems.

Referring generally to the figures, a cooling system 42 for use in a refrigerator 10 is provided. The refrigerator 10 may include a cabinet 13 that may be provided with an inner liner 44 and an outer wrapper 32, the inner liner 44 and the outer wrapper 32 may collectively form at least portions of a machine compartment 48. The inner liner 44 may at least partially form a number of compartments including, but not limited to, a refrigerator compartment 12, a freezer compartment 24, and an ice maker compartment 30. As an example, the ice maker compartment 30 may be disposed in another compartment such as the refrigerator compartment 12 or the freezer compartment 24. As another example, the ice maker compartment 30 may not be disposed in another compartment and may be formed as a standalone compartment.

The cooling system 42 may include a heat exchanger mounting assembly 50 that may include an air distribution plenum 52 and a cover member 54. The air distribution plenum 52 may include a first side 52*a* and a second side 52*b*, the first side 52*a* may face away or oppose the second side 52*b*. The air distribution plenum 52 may define a number of apertures and passages configured to receive and route air along and/or through the air distribution plenum 52. A heat exchanger 60, such as an evaporator 62 may be coupled (e.g., attached, coupled to) the second side 52*b* of the air distribution plenum 52 and the air distribution plenum may be disposed in the machine compartment 48. The evaporator 62 may be configured to remove heat from air received from one or more of the compartments 12, 24, 30 so that the air is cooled and may be returned to the compartments 12, 24, 30. In one or more embodiments, the cooling system may include a number of air ducts that may be arranged to route air to and from the machine compartment 48 to one or more of the compartments 12, 24, 30. As an example, a refrigerator compartment return air duct 70 may be provided to return air from the refrigerator compartment 12 to the machine compartment or more specifically, to an area near or covering the evaporator 62.

One or more fans, such as a primary fan 64 and a secondary fan 66 may be arranged to direct air that is cooled by the evaporator 62 to one or more of the compartments 12, 24, 30. As an example, the primary fan 64 may be configured to draw in cooled air from the machine compartment 48 and direct the cooled air to the refrigerator compartment 12, freezer compartment 24, or both and the secondary fan 66 may be configured to route the air to the ice maker compartment 30. In one or more embodiments, a damper, for example, an electronic air damper 68 may be arranged and configured to selectively block or at least partially block air from traveling from one or more of the fans 64, 66 (e.g., the primary fan 64) to one or more of the compartments (e.g., the refrigerator compartment 12).

The controller or electronic air damper 68 may be configured to operate the primary fan 64 independent from the secondary fan 66. The primary fan 64 may be configured to route fluid through a number of passages 126 defined by the air distribution plenum 52 so that cooled air is directed from the heat exchanger 60 to one or more of the compartments. Whereas the secondary fan 66 may be configured to route cooled air through an aperture or outlet formed by the air distribution plenum 52 that may be separate and sealed from the passages that communicate cooled air from the primary fan 64. This arrangement may provide improved efficiency as only one fan (e.g., either the primary or secondary fans 64, 66) may be required for operation. Sealing or isolating the passages that communicate air from the primary fan 64 from the passages that communicate air from the secondary fan 66 may prevent mixing of cooled air provided by the primary and secondary fans 64, 66.

FIG. 1 illustrates a refrigerator designated by reference numeral 10 having a cabinet structure 13 with a front surface 14 opening into a refrigerator compartment 12. The refrigerator may be of the French-Door Bottom Mount type, but it is understood that this disclosure could apply to any type of refrigerator, such as a side-by-side, two-door bottom mount, or top-mount type. The cabinet structure 13 may include a vacuum insulated cabinet structure, as further described below. The refrigerator compartment 12 is contemplated to be an insulated portion of the cabinet structure 13 for storing fresh food items. First and second doors 18, 20 are rotatably coupled to the cabinet structure 13 near the front surface 14 thereof for selectively providing access to the refrigerator compartment 12 by pivoting movement between open and closed positions. In the embodiment shown in FIG. 1, a freezer drawer 22 is configured to selectively provide access to a freezer compartment 24 disposed below the refrigerator compartment 12. The refrigerator 10 shown in FIG. 1 is an exemplary embodiment of a refrigerator for use with the present disclosure and is not meant to limit the scope of the present concept in any manner.

As further shown in FIG. 1, the first door 18 includes a dispensing station 2 which may include one or more paddles 4, 6 which are configured to initiate the dispensing of water and/or ice from outlets disposed within the dispensing station 2. In the embodiment shown in FIG. 1, the dispensing station 2 is shown as being accessible from outside of the refrigerator 10 on an exterior portion of the first door 18 but may also be provided along any portion of the refrigerator 10, including an interior of the refrigerator compartment 12, for dispensing ice and/or water. The dispensing station 2 is contemplated to be coupled to an ice maker 30 which is shown in phantom in FIG. 1. It is contemplated that the ice maker 30 may be operably coupled to the first door 18 to pivotally move with the first door 18 between open and closed positions. Further, it is contemplated that the ice maker 30 may be fixedly positioned within the refrigerator compartment 12. As further shown in FIG. 1, the cabinet structure 13 of the refrigerator 10 includes an outer wrapper 32 which includes first and second sidewalls 34, 36, a top wall 38 and a rear wall 40. The exterior wrapper 32 is contemplated to be a metal component formed of a sheet metal material.

Figure 2A:
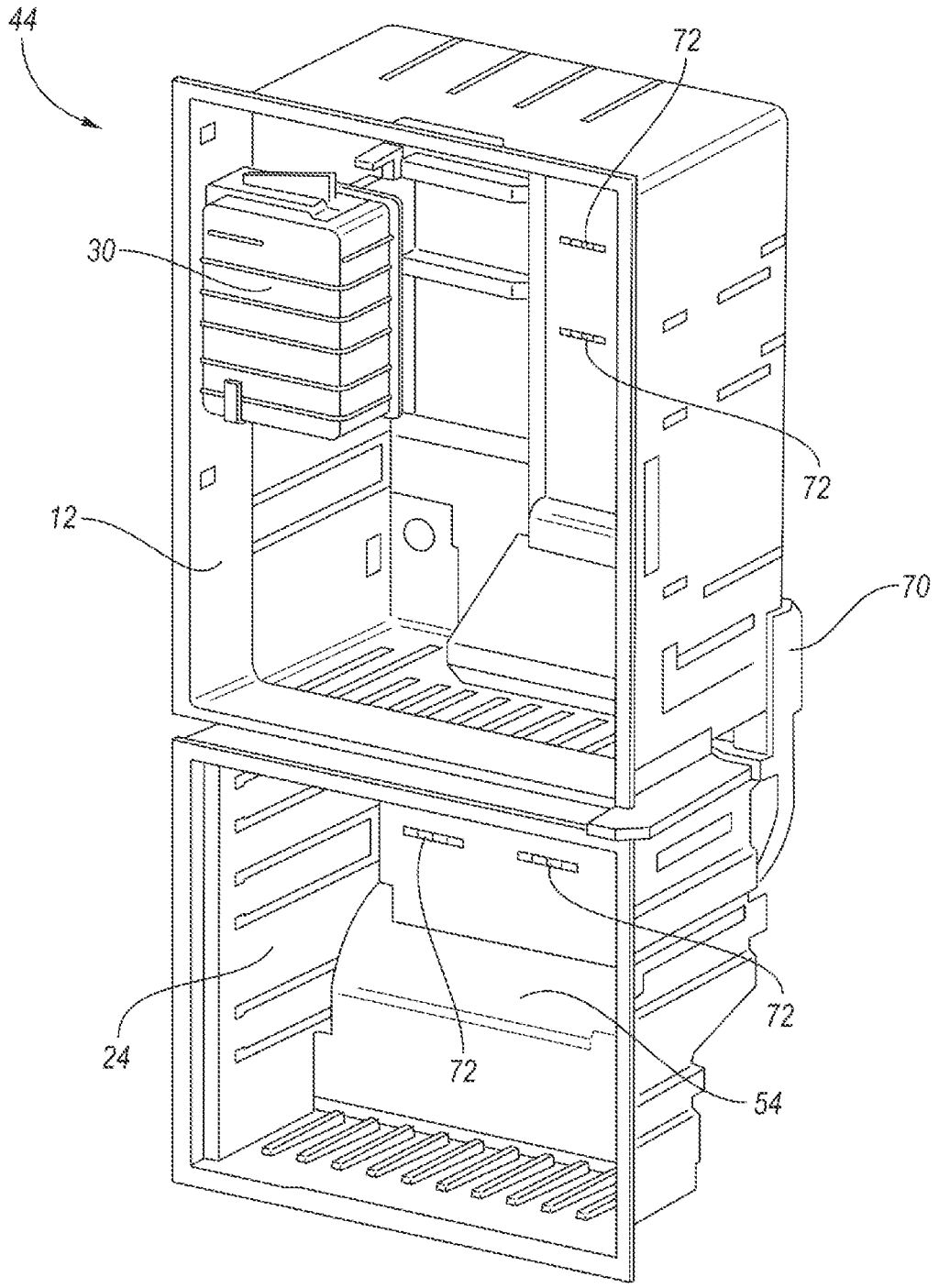
FIG. 2A illustrates a front-perspective view of an inner liner of the exemplary refrigerator illustrated in FIG. 1
Figure 2B:
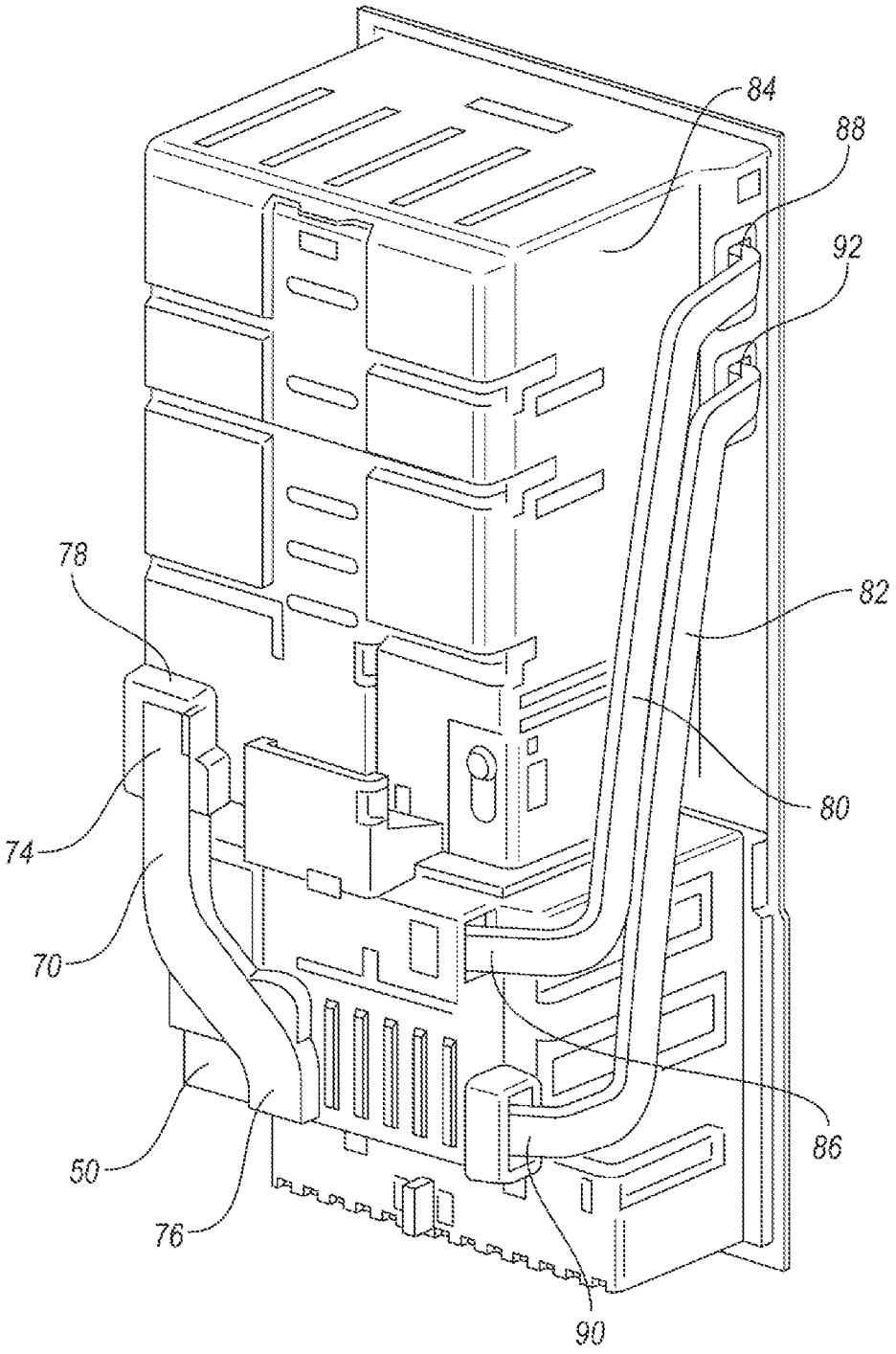
FIG. 2B illustrates a rear-perspective view of the inner liner illustrated in FIG. 2A.

FIG. 2A illustrates a front-perspective view of the inner liner 44 according to one or more embodiments. FIG. 2B illustrates a rear-perspective view of the inner liner illustrated in FIG. 2A. The front of the inner liner 44 may form openings that provide access to the refrigerator compartment 12, the freezer compartment 24, and the ice maker compartment 30. As an example, the ice maker compartment 30 may be disposed in the refrigerator compartment 12, though in other embodiments, the ice maker compartment 30 may be disposed in the freezer compartment 24 or another suitable compartment. In one or more embodiments, the cabinet 13 may be configured for use in a vacuum-insulated refrigerator.

Figure 3A:
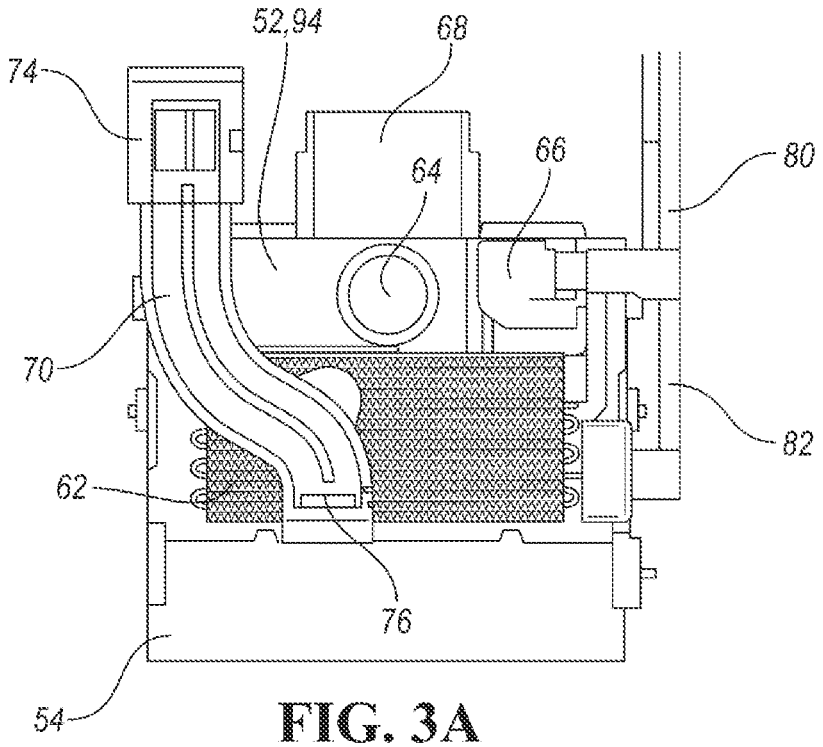
FIGS. 3A-3B illustrate a plan view and a rear-perspective view, respectively, of a portion of an exemplary cooling system for use in the refrigerator illustrated in FIG. 1 or another refrigerator.

A portion of the heat exchanger mounting assembly 50, such as a cover member 54 may be disposed in a rear portion of the freezer compartment 24. Rear portions of the inner liner 44 may include one or more outlets or vents 72 that may vent cooled air received from the evaporator 62 to the freezer compartment 24 and the refrigerator compartment 12. The refrigerator compartment return air duct 70 may include a first end 74 and a second end 76, the first end 74 may be arranged to cover or overlap portions of the refrigerator compartment 12 and the second end 76 may be arranged to cover or overlap a portion of the heat exchanger mounting assembly 50 such as the evaporator 62 (FIG. 3A). The first end 74 of the refrigerator compartment return air duct 70 may include an inlet member 78 that may surround portions of the first end 74 of the refrigerator compartment return air duct 70.

One or more air ducts may extend from the heat exchanger mounting assembly 50 to the ice maker compartment 30. As an example, an ice maker supply duct 80 and an ice maker return duct 82 may extend from a lateral surface 84 of the inner liner 44 to the heat exchanger mounting assembly 50. The ice maker supply duct 80 may include a first end 86 positioned adjacent to the secondary fan 66 (FIG. 3A) and a second end 88 that may be fixed to the lateral surface 84. The ice maker return duct 82 may include a first end 90 that may be adjacent to the evaporator 62 and a second end 92 that may be fixed to the lateral surface 84 of the inner liner 44.

Figure 3B:
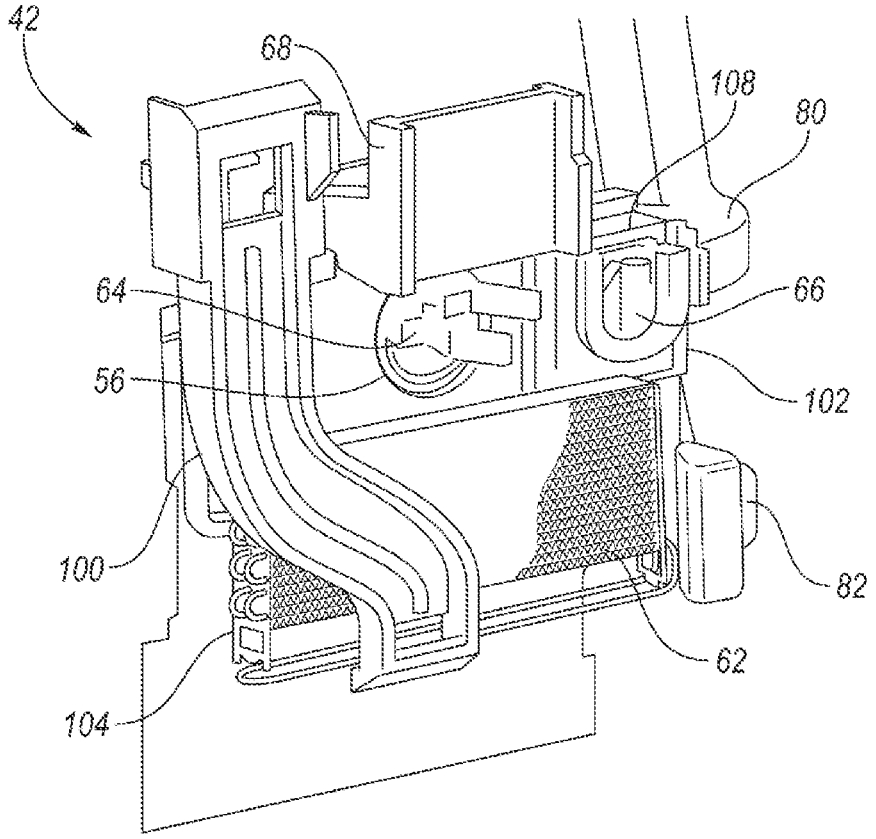

FIG. 3A illustrates a plan view of the cooling system 42 according to one or more embodiments and FIG. 3B illustrates a rear-perspective view of the cooling system 42. The cooling system 42 may include the cover member 54 that may carry or support the air distribution plenum 52. The air distribution plenum 52 may include a main body 94 including a top portion or top surface 96, a bottom portion or bottom surface 98, and first and second lateral surfaces 100, 102. As an example, the evaporator 62 may be disposed between the lateral surfaces 100, 102 and the evaporator 62 may overlap or cover the bottom surface 98 of the air distribution plenum 52. The bottom surface 98 and the top surface 96 may also refer to portions of the main body 94 that extend from peripheral top and bottom surfaces 96, 98 towards a middle section 106 (FIG. 5) of the main body 94. One or more portions of the evaporator 62 may be supported by an arm 104 that may extend from the main body 94 of the air distribution plenum 52.

As mentioned above, the air distribution plenum 52 may include a first side 52*a* and a second side 52*b* that may oppose the first side 52*a*. Portions of the air distribution plenum 52, such as the top portion 96, may define the aperture 56 and the aperture 56 may be disposed in the top portion 110 between the evaporator 62 and the top surface 96. The aperture 56 may be sized to receive the main or primary fan 64 and as an example, to form a force-fit connection between the periphery of the aperture 56.

In one or more embodiments, a protrusion 112 may extend from the second side 52*b* of the air distribution plenum 52 in a direction opposite the first side 52*a* of the air distribution plenum 52. The first protrusion 112 may extend from the top portion 110 and may be disposed between the second lateral surface 102 and the aperture 56. Portions of the protrusion 112, such as the surface lying parallel to the second side 52*b* may form a recess such as a pocket 114 that may be configured to receive the secondary fan 66. A lateral surface of the protrusion, that may be arranged parallel to the second lateral surface 102, may define an aperture such as an outlet 116 that may be configured to route or direct cooled air from the evaporator 62 to the ice maker compartment 30 (e.g., via the ice maker supply duct 80). As an example, the first end 86 of the ice maker supply duct 80 may be fixed or disposed within portions of the outlet 116 so that air generated by one or more of the fans (e.g., secondary fan 66) may be directed through the ice maker supply duct 80.

The refrigerator compartment return air duct 70 may include one or more curved portions, and as an example, the refrigerator compartment return air duct 70 may be S-shaped. The first end 74 and the second end 76 may each be substantially straight and portions extending therebetween may be curved. The first end 74 may be disposed above and/or spaced apart from the top surface 96 (FIG. 6) of the air distribution plenum 52 and the second end 76 may be disposed below and/or spaced apart from the bottom surface 98 of the air distribution plenum 52. The first end 74 of the refrigerator compartment return air duct 70 and the second end 76 of the refrigerator compartment return air duct 70 may be positioned offset from one another with respect to the lateral or horizontal direction. As an example, the first end 74 of the refrigerator compartment return air duct 70 may be arranged closer to the first lateral surface 100 than the second end 74 of the refrigerator compartment return air duct 70 and the second end 74 may be arranged between the primary fan 64 and the first lateral surface 100. The second end 74 of the refrigerator compartment return air duct 70 may extend to sandwich the evaporator 62 to the air distribution plenum 52.

The primary fan 64, the secondary fan 66, or both, may be positioned with respect to the main body 94 of the air distribution plenum 52 so that when the air distribution plenum 52 is assembled to the inner liner 44, the primary fan 64 and the secondary fan 66 overlap or cover a bottom compartment (e.g., the freezer compartment 24) of the refrigerator 10. One or more of the fans (e.g., the primary fan) may be configured to direct cooled air from the evaporator 62 from the second side 52*b* of the air distribution plenum 52 to the first side 52*a* and into the freezer compartment 24. Alternatively or additionally, the primary fan 64 may direct air in a vertical direction to the refrigerator compartment 12. As an example, the top surface 96 of the air distribution plenum 52 may define an aperture 118 (FIG. 5) that may be configured to direct cooled air to the refrigerator compartment 12 (e.g. through vents 72 illustrated in FIG. 2A). The aperture 118 may be centrally located with respect to the primary fan 64, the electronic air damper 68, or both.

The electronic air damper 68 may be communicatively coupled to a controller or processor (not illustrated). In one or more embodiments, the controller or processor may be integral with the electronic air damper 68. The controller may be programmed with an algorithm to prioritize providing cooled air from the evaporator 62 to the freezer compartment 24 unless another compartment such as the refrigerated compartment 12 exceeds a temperature (e.g., a setpoint temperature). The controller may be configured to communicate with a number of sensors to monitor a one or more properties related to temperature control of the refrigerator 10, such properties include, but are not limited to, temperature of one or more of the compartments (e.g., refrigerator compartment 12, freezer compartment 24, ice maker compartment 30), mass air flow sensors configured to monitor volume of air flowing through one or more of the air ducts (e.g., the refrigerator compartment return air duct 70, the ice maker supply duct 80, and the ice maker return duct 82.

Figure 4:
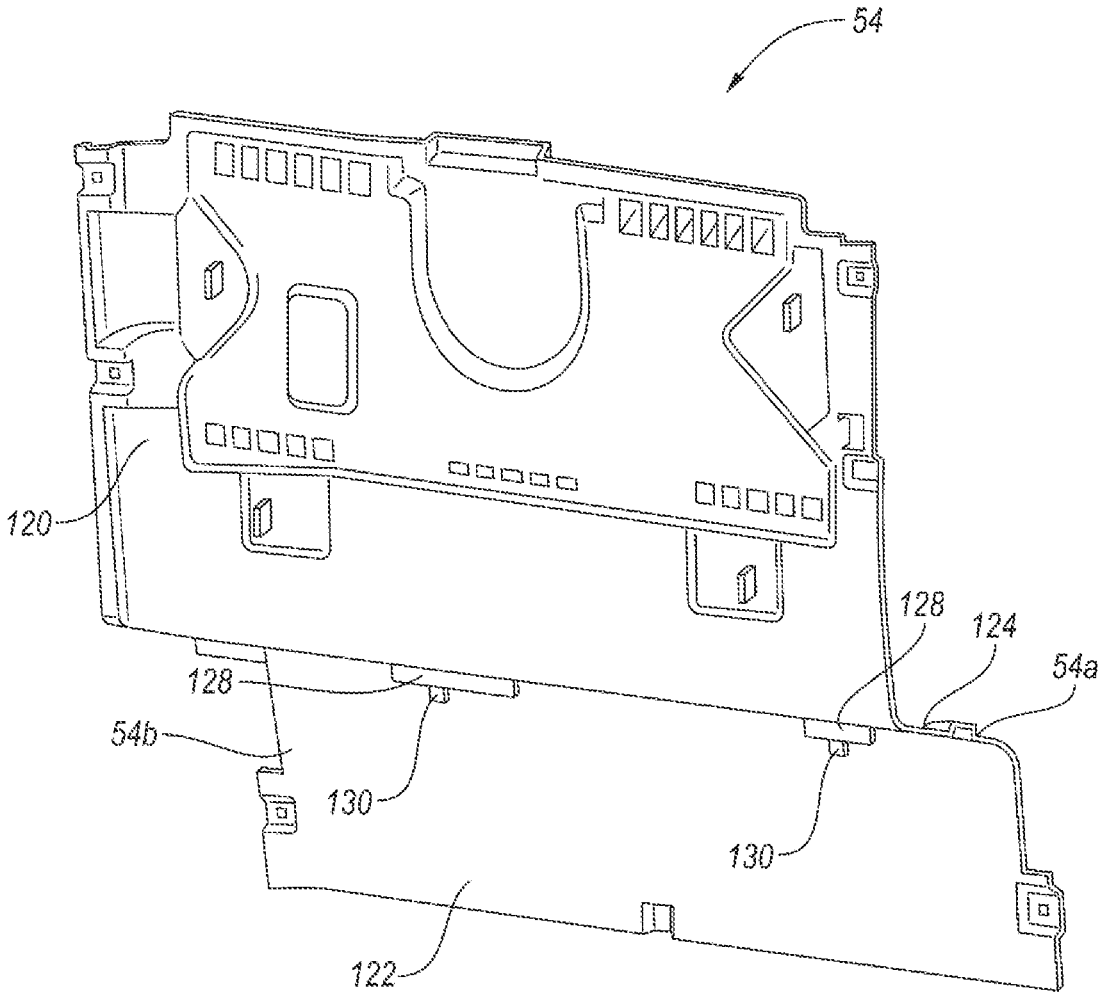
FIG. 4 illustrates a rear-perspective view of an exemplary cover member of the cooling system illustrated in FIGS. 3A-3B.

FIG. 4 illustrates a rear-perspective view of the cover member of the cooling system 42 according to one or more embodiments. The cover member 54 may include a first side 54*a*, that may face towards the front of the refrigerator 10, and a second side 54*b* that may face towards the rear of the refrigerator 10. The cover member may include a top portion 120 that may be connected to a bottom portion 122 by a medial portion 124. As an example the medial portion 124 may include curved portions that each extend to the top and bottom portions 120, 122, respectively. The top portion 120 of the cover member 54, such as the second side 54*b* of the top portion 120, may be configured to receive the air distribution plenum 52. The bottom portion 122 may form portions of a bottom compartment (e.g., the freezer compartment 24) of the refrigerator and the second side 54*b* of the bottom portion 122 may form at least a portion of the machine compartment 48.

In one or more embodiments, the cover member 54 may include a number of flanges 128 that may extend from the medial portion 124 in a direction that may be substantially parallel to the bottom portion 122. The flange 128 may include one or more locking tabs 130 that may extend from a main portion of the flange 128. The air distribution plenum 52 may include one or more locking protrusions 132 (FIG. 5) and the locking tabs 130 may be inserted into a recessed portion or pocket defined by one or more of the locking protrusions 132.

Figure 5:
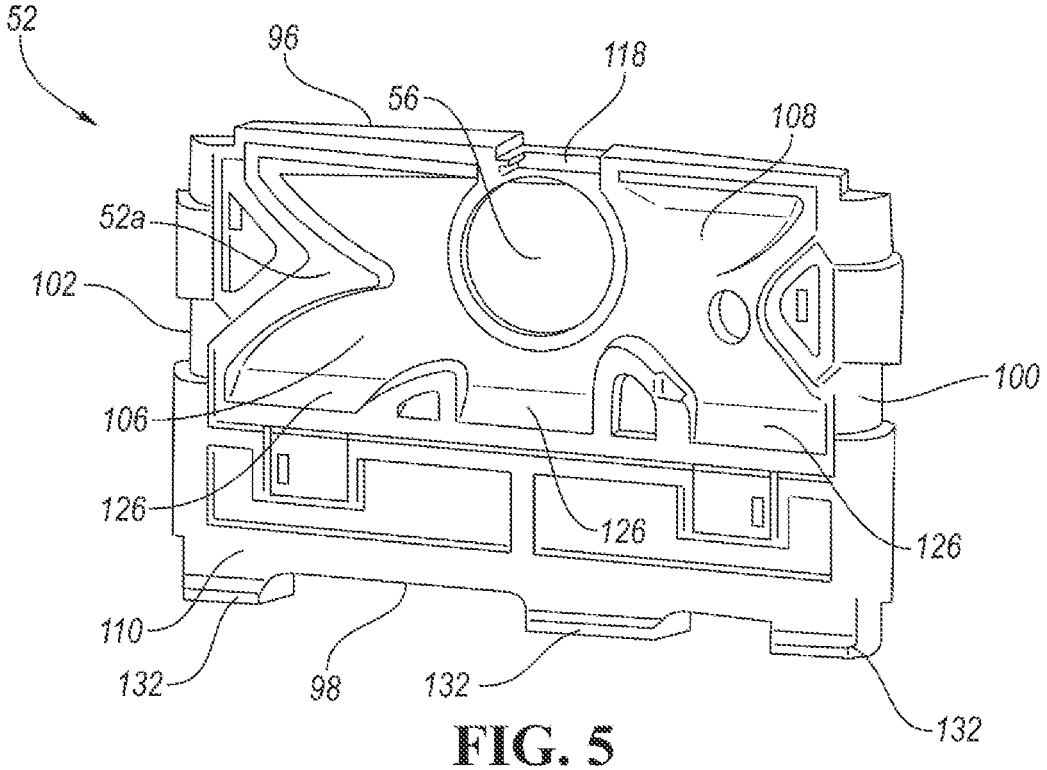
FIG. 5 illustrates a front-perspective view of an air distribution plenum of the cooling system illustrated in FIGS. 3A-3B.

FIG. 5 illustrates a front-perspective view of an air distribution plenum 52 according to one or more embodiments. The air distribution plenum 52 may include the first side 52*a* and the second side 52*b* that may oppose the first side 52*a*. The first and second sides 52*a*, 52*b* may extend in a vertical direction between the top surface 96 and the bottom surface 98 and in a horizontal direction between the first and second lateral surfaces 100, 102. The air distribution plenum 52 may include a top portion 108 and a bottom portion 110. The top portion 108 may include the top surface 96 and may extend to a middle section 106 and the bottom portion 110 may include the bottom surface 98 and may extend to the middle section 106. The first side 52*a* may define a number of passages 126 that may extend from the top portion 108 to the middle section 106. The passages 126 may be configured to receive cooled air from the primary fan 64 and direct the cooled air to a bottom compartment of the refrigerator (e.g., the freezer compartment 24).

Figure 6:
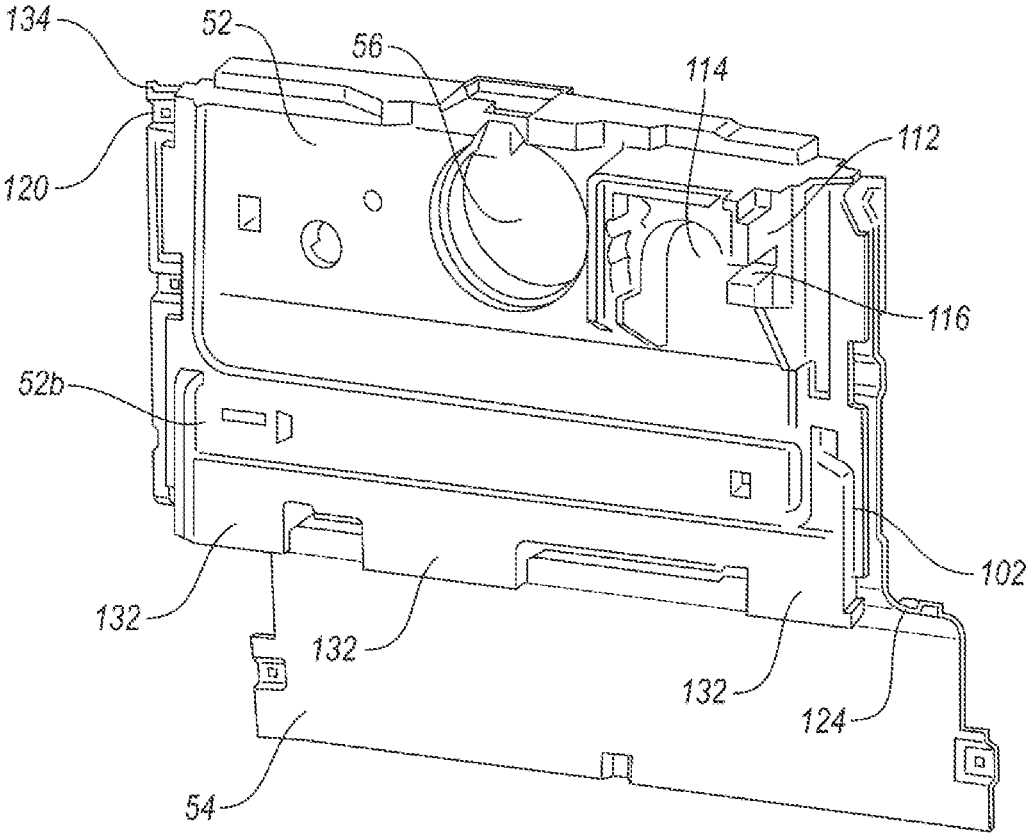
FIG. 6 illustrates a rear-perspective view of the air distribution plenum attached to the cover member.

FIG. 6 illustrates a rear-perspective view of the air distribution plenum 52 attached to the cover member 54. For purposes of clarity, the primary fan 64 and the secondary fan are not illustrated. When the air distribution plenum 52 is assembled to the cover member 54, the second side 52*b* of the air distribution plenum 52 may face away from the top portion 120 of the cover member 54. As an example, the top portion 120 of the cover member include a top surface 134 and portions of the air distribution plenum 52 may be spaced apart from the top surface 134 of the cover member. A bottom portion of the air distribution plenum 52, such as the locking protrusions 132 may be positioned to overlap or cover the medial portion 124 of the cover member 54.

As mentioned above, the air distribution plenum 52 may define the main fan aperture 56 and the pocket 114. The main fan aperture 56 may receive the primary fan 64 and the pocket 114 may receive the secondary fan 66. The pocket 114 may be defined by the protrusion 112 that may extend from the second side 52*b* of the air distribution plenum 52 in a direction facing away from the cover member 54. The protrusion 112 may define an outlet 116 that may be configured to receive the ice maker supply duct 80. As one example, an inner periphery of the outlet 116 may be configured to provide or form a seal between the first end 86 of the ice maker supply duct 80. Alternatively or additionally, one or more seals may be disposed between the inner periphery of the outlet 116 and an outer periphery of the first end 86 of the ice maker supply duct 80.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A cooling system for use in a refrigerator including a number of compartments, the cooling system comprising:

a heat exchanger mounting assembly provided with an air distribution plenum including a first side and a second side, and defining a first aperture and a second aperture, wherein at least one of the first aperture and the second aperture extends through the air distribution plenum from the first side to the second side, the first side forms a number of passages fluidly connected to a first compartment and a second compartment each of the number of compartments, respectively, wherein the number of passages (i) are defined along recessed surfaces that protrude inward along the first side, (ii) are fluidly connected to the first aperture, and (iii) do not extend through the plenum to the second side;

a heat exchanger disposed on the heat exchanger mounting assembly;

a first fan coupled to the heat exchanger mounting assembly and configured to direct air from the heat exchanger through the first aperture to a first passage and a second passage each of the number of passages;

a second fan coupled to the heat exchanger mounting assembly and configured to direct air from the heat exchanger through the second aperture to a third compartment of the number of compartments;

an air damper fixed to the heat exchanger mounting assembly and configured to selectively block the air from at least one of the first fan and the second fan; and a first air duct including a first end and a second end, the first end covering portions of first compartment and the second end disposed adjacent to the heat exchanger.

2. The cooling system of claim 1, wherein the first compartment is a refrigerator compartment, and the first air duct is a return duct configured to direct air from the refrigerator compartment to the heat exchanger.

3. The cooling system of claim 2, wherein the first air duct is substantially S-shaped.

4. The cooling system of claim 1, wherein the air distribution plenum includes a main body, provided with a top portion and a bottom portion, and an arm extending from the bottom portion of the main body, wherein the arm is configured to carry at least portions of the heat exchanger.

5. The cooling system of claim 1, wherein the second end of the first air duct and the second side of the air distribution plenum sandwiches the heat exchanger.

6. The cooling system of claim 1, wherein the first air duct extends substantially in a vertical direction, and with respect to a horizontal direction, substantially orthogonal to the vertical direction, the first fan is disposed between the second fan and portions of the first air duct.

7. The cooling system of claim 6, wherein with respect to the vertical direction, the first fan is disposed between the air damper and the heat exchanger.

8. The cooling system of claim 7, wherein with respect to the vertical direction, the second fan is disposed between the air damper and the heat exchanger.

9. The cooling system of claim 8, wherein the third compartment is an ice maker compartment, and the ice maker compartment is disposed in the first compartment.

10. The cooling system of claim 9, further comprising:

a second air duct configured to communicate cooled air from the second fan to the ice maker compartment; and a third air duct configured to communicate air from the ice maker compartment to the heat exchanger, wherein the second air duct and the third air duct are each disposed between a lateral surface of the air distribution plenum and an outer wrapper of the refrigerator.

11. The cooling system of claim 1 further comprising a second air duct, wherein (i) the second side of the air distribution plenum includes a protrusion extending away from the first side of the air distribution plenum, (ii) the second fan is received by a third aperture defined by the protrusion, (iii) a lateral surface of the protrusion defines the second aperture, and (iv) the second air duct includes a first end configured to communicate cooled air from the second aperture to the third compartment.

12. A refrigerator comprising:

a cabinet forming a number of refrigerated compartments and provided with an inner liner and an outer wrapper, the inner liner and the outer wrapper collectively forming a machine compartment;

a mounting member disposed in the machine compartment, wherein the mounting member includes a top portion, a bottom portion, a first side and a second side, the first side forms a number of passages fluidly connected to a first refrigerated compartment of the number of compartments and a second refrigerated compartment of the number of compartments, respectively, the second side includes a protrusion disposed in the top portion and extending away from the first side, and a lateral surface of the protrusion defines an outlet;

an evaporator disposed on the second side of the mounting member and overlapping the bottom portion;

a first fan fixed to the top portion of the mounting member and configured to direct cooled air from the evaporator to at least one of the first refrigerated compartment and the second refrigerated compartment;

a second fan fixed to the top portion of the mounting member, received by an aperture defined by the protrusion, and configured to direct cooled air from the evaporator to at least one of the second refrigerated compartment or a third refrigerated compartment of the number of refrigerated compartments;

a first air duct configured to route air between the first refrigerated compartment and the machine compartment, wherein the first air duct is disposed on a first side of the first fan and the second fan is disposed on a second side of the first fan; and a second air duct configured to route air between the second refrigerated compartment and the machine compartment, wherein the first fan and the second fan are each disposed between the first and second air ducts, wherein the second air duct includes a first end configured to communicate cooled air from the outlet defined by the protrusion to the second refrigerated compartment.

13. The refrigerator of claim 12, wherein the top portion includes a top surface defining a second aperture configured to receive and route cooled air from the first fan to the first refrigerated compartment, wherein the first refrigerated compartment is a refrigerator compartment.

14. The refrigerator of claim 13, further comprising:

a damper fixed to the top portion and configured to selectively cover and uncover the second aperture to block the cooled air from traveling from the first fan to the refrigerator compartment.

15. The refrigerator of claim 14, wherein the damper, the second aperture, and the first fan are substantially aligned with one another with respect to a direction extending between the top portion and the bottom portion of the mounting member.

16. A refrigerator comprising:

a cabinet including an inner liner and an outer wrapper, the inner liner at least partially forming a refrigerator compartment, an ice maker compartment, and a freezer compartment, and the inner liner and the outer wrapper collectively forming a machine compartment;

a mounting member disposed in the machine compartment, wherein the mounting member includes a first side and a second side each extending in a vertical direction between a top surface and a bottom surface and each extending in a horizontal direction between a first lateral surface and a second lateral surface, wherein the first side forms a number of passages fluidly connected to the freezer compartment, the number of passages are defined along recessed surfaces that protrude inward along the first side, the number of passages do not extend through the mounting member to the second side, and the top surface defines a first aperture fluidly connected to the refrigerator compartment;

a heat exchanger disposed on the second side of the mounting member;

a first fan disposed in a second aperture extending between the first side and the second side of the mounting member, wherein the first fan is configured direct cooled air from the second side of the mounting member through the first and second apertures to the refrigerator compartment and the freezer compartment, respectively, wherein the number of passages are fluidly connected to the second aperture such that the first fan is configured to direct cooled air from the second side of the mounting member through the second aperture and to freezer compartment via the number of passages;

a second fan configured to direct cooled air from the heat exchanger to the ice maker compartment; and a damper disposed on the top surface of the mounting member and configured block cooled air from at least one of the first fan and the second fan, wherein the first and second fans are disposed between the heat exchanger and the top surface of the mounting member.

17. The refrigerator of claim 16, wherein the heat exchanger is the only heat exchanger disposed on the mounting member.

18. The refrigerator of claim 17, wherein the heat exchanger is an evaporator.

19. The refrigerator of claim 16, wherein (i) the second side of the mounting member includes a protrusion extending away from the first side of the mounting member, (ii) the second fan is received by a third aperture defined by the protrusion, (iii) a lateral surface of the protrusion defines an outlet, and (iv) an air duct is configured to communicate cooled air from the outlet to the ice maker compartment.

* * * * *